United States Patent [19]

Wilson

[11] 4,017,075

[45] Apr. 12, 1977

[54] SIMULATED FOOTBALL GAME

[76] Inventor: Sheldon B. Wilson, P.O. Box 3005, Austin, Tex. 78764

[22] Filed: Aug. 11, 1975

[21] Appl. No.: 603,390

[52] U.S. Cl. ..... 273/94 R; 58/144; 273/142 B; 273/142 G

[51] Int. Cl.[2] ..... A63F 7/06

[58] Field of Search ..... 273/94 R, 142 D, 142 E, 273/142 F, 142 G, 142 B; 58/144

[56] References Cited

UNITED STATES PATENTS

| | | | |
|---|---|---|---|
| 2,784,970 | 3/1957 | Heiner | 273/94 R |
| 3,556,525 | 1/1971 | Pegg | 273/94 R |
| 3,814,426 | 6/1974 | Moe | 273/94 R |
| 3,871,652 | 3/1975 | Schreier | 273/94 R |

*Primary Examiner*—Anton O. Oechsle
*Attorney, Agent, or Firm*—Pravel, Wilson & Gambrell

[57] ABSTRACT

A game for simulating the play of football to be played by at least two opposing players wherein an action sled is movably mounted adjacent a playing field board which simulates a football field and is movable along the length of the board, the action sled having devices therewith provided for selecting the type of play and the direction of the play of each of the opposing players for their respective offensive and defensive simulated football plays and including a mechanism for randomly selecting penalty and non penalty situations for either of the opposing players during each simulated football play. A further feature includes a timing device for signalling the expiration of intervals of time. A further feature includes a random selection device having a rotatable head mounted on an upstanding base portion wherein a movable element is disposed within a cavity formed within the head to be randomly moved about to a plurality of positions in the cavity by rotation of the head.

18 Claims, 8 Drawing Figures

Fig. 3
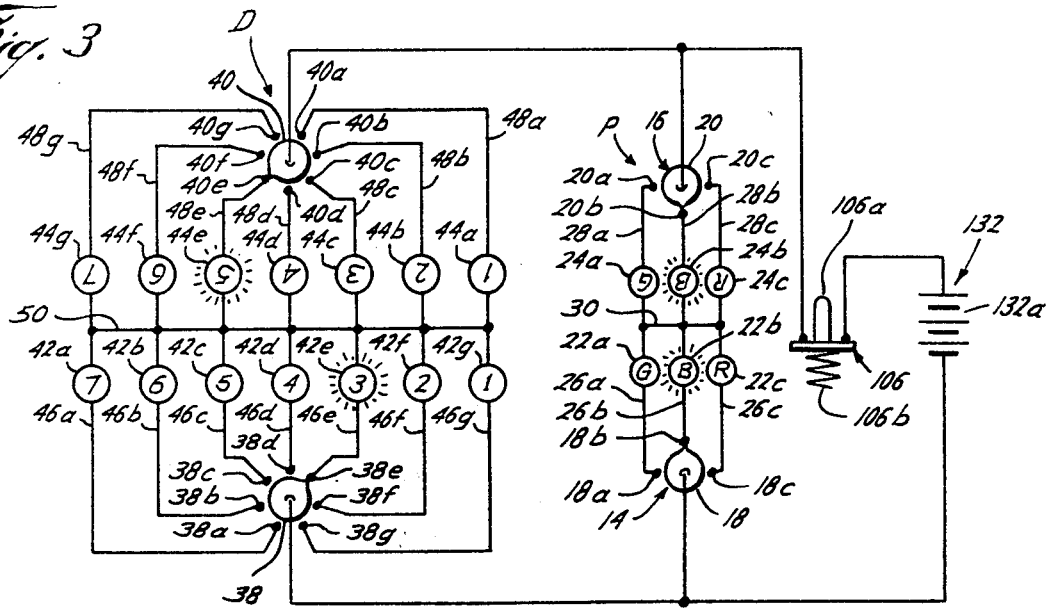
Fig. 4
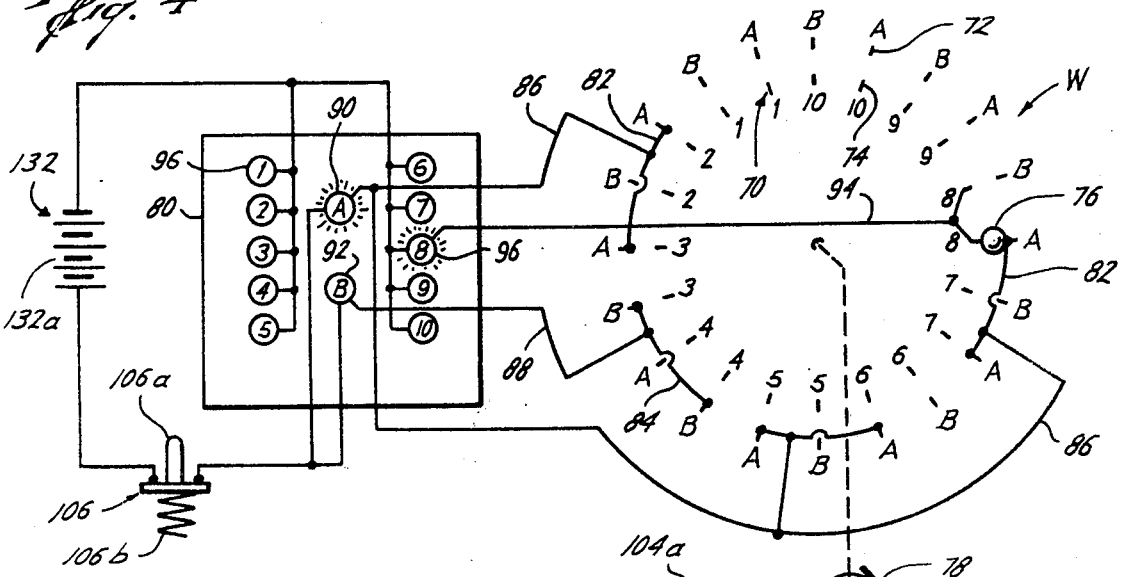
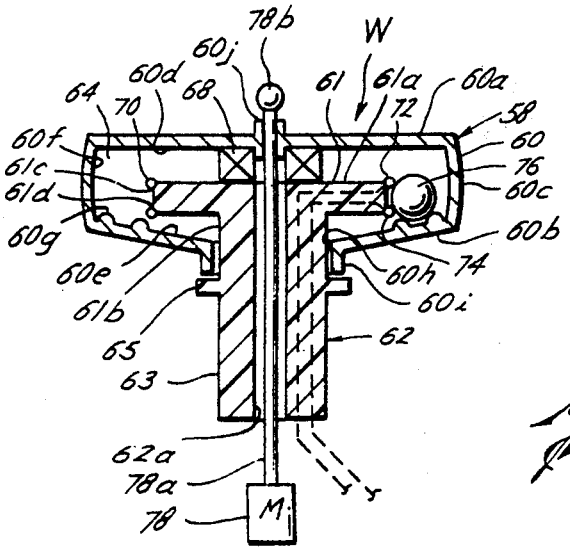
Fig. 5

SIMULATED FOOTBALL GAME

BACKGROUND OF THE INVENTION

The field of this invention is games and associated timing and random selecting devices, particularly of the type relating to and simulating the play of football.

Numerous prior art games simulate the play of football, such as those disclosed in U.S. Pat. No. 1,596,175; 2,780,461; 3,123,360; 3,554,548; 3,556,525; and 3,606,330.

So far as known, no prior art reference was found indicating use of a movable carriage that moves along a playing board wherein the carriage includes means for each player to decide upon their own offensive and defensive strategies as well as incorporating a random selection device for determining a non-penalty-penalty situation during simulated football play.

SUMMARY OF THE INVENTION

The present invention relates to a new and improved game for simulating the play of football to be played by at least two opposing players. The game of this invention preferably includes a playing field board simulating a football field and having an action sled mounted adjacent the board and movable along the length of the board with the action sled having a first player end and a second player end with each of the ends having means for selecting a particular type of play as well as the direction of the play for both offensive and defensive strategical maneuverings and further having a random selection device for randomly designating a penalty and a non-penalty situation for either of the opposing players during each simulated football play.

Also, the present invention includes a new and improved timing device for a game including a housing having a liquid chamber formed therein for disposing a movable contact within such liquid such that the contact moves from one end of the housing to the other making electrical connections at either end with fixed contacts to signal the expiration of time.

Also, the present invention may include a new and improved game random selection device having a rotatable head and an upstanding base with the rotatable head having a cavity formed therein and adapted to receive a movable element freely disposed in the cavity, the movable element adapted to be randomly moved about the cavity by rotation of the head, the base having a plurality of positions about the upper end of the base and adapted to receive the movable element for indicating particular random positions.

DESCRIPTION OF THE DRAWINGS

FIG. 3 is a schematic electrical circuitry diagram showing the preferred embodiment of the circuitry of the play selection devices and the direction selection devices of the present invention;

FIG. 4 is a schematic electrical circuitry diagram showing the preferred embodiment of the circuitry of the random selection device with the foul indicator light board;

FIG. 5 is an elevational sectional view of the random selection device of the present invention;

DESCRIPTION OF THE PREFERRED EMBODIMENT

Figure 1:
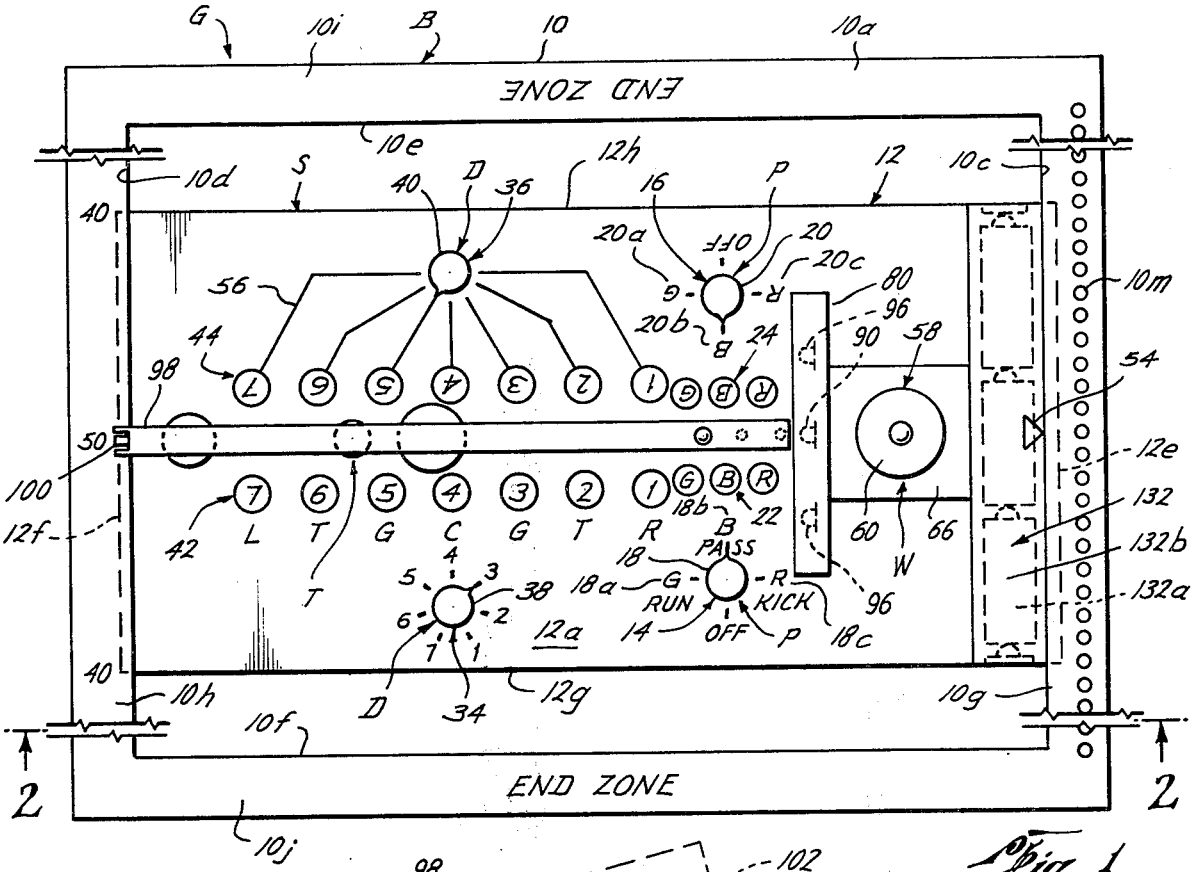
FIG. 1 is a plan view, partly in section, of the game of the present invention.

In the drawings, the letter G designates the game for simulating play of football of the present invention. The game G includes a playing field board B having an action sled S movably mounted on the playing field borad B. The action sled S has play selection means P, direction selection means D, game timing means T, and random selection means W appropriately mounted therewith. Unless otherwise noted, the components of this invention are made of wood, plastic, paper, or any other suitable material capable of being easily manufactured and havng durable quality for long-lasting, reliable use thereof.

Figure 2:
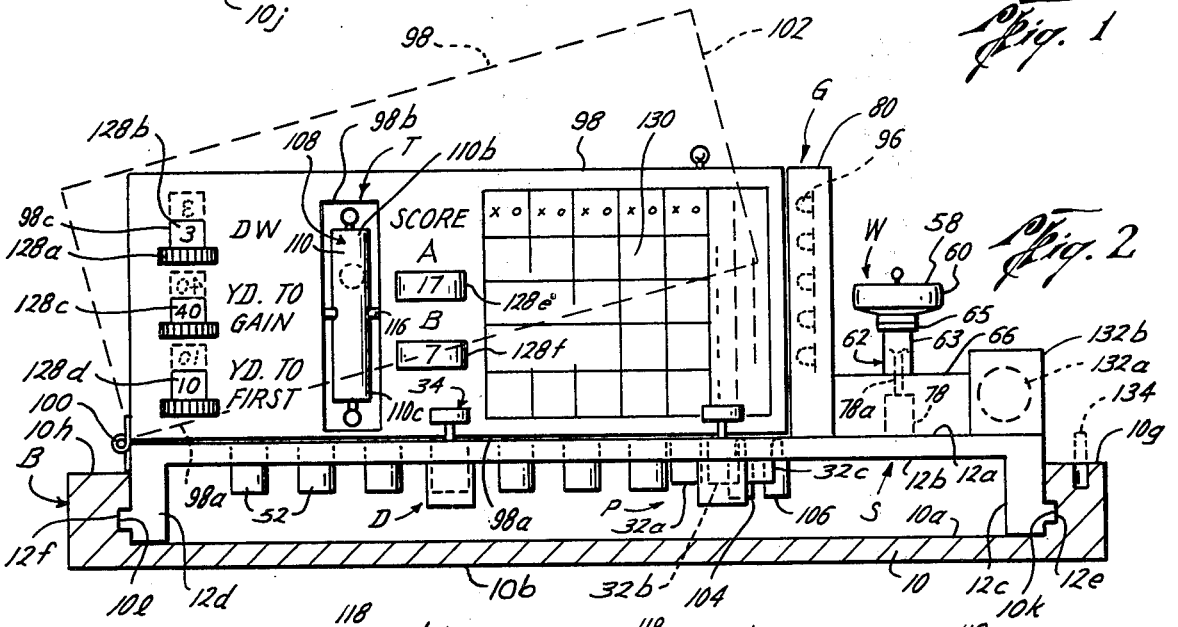
FIG. 2 is an elevational view, partly in section, of the game of the present invention, taken along the lines 2—2 of FIG. 1.

As shown in FIGS. 1 and 2, the playing field board B of the game G of the present invention includes board surface 10 having an upper surfce 10*a* and a lower surface 10*b*. *The lower surface 10b* is intended to rest upon any suitable surface (not shown) for playing the game G of the present invention, such as a table, floor or any other suitable supporting structure. The upper surface 10*a* of the board surface 10 preferably simulates a football field according to the appropriate markings thereof. As in a football field, the playing field board B is of a substantially rectangular configuration having longitudinal sides 10*c*, 10*d* and adjoining end portions 10*e*, 10*f*, respectively. Longitudinally extending side rails 10*g*, 10*h* are mounted adjacent longitudinal sides 10*c*, 10*d*, respectively, and end zone portions 10*i*, 10*j* of board surfce 10 adjacent end portions 10*e*, 10*f*, respectively. Thus side rails 10*g*, 10*h* form upstanding longitudinal guides along the upper board surface 10*a*. Channels 10*k*, 10*l* are formed in side rails 10*g*, 10*h*, respectively, and may be of any suitable configuration such as U-shaped, V-shaped, rectangularly-shaped or any other suitable shape as will be discussed more fully hereinbelow. Furthermore, a plurality of holes 10*m* are preferably formed with the upper surface of side rail 10*g* with each of such holes 10*m* corresponding to an appropriate yardline. Yardlines (not shown) preferably extend therebetween and transverse to longitudinal sides 10*c*, 10*d* and designate the appropriate football yardline grid markings. Beginning with the end zone portion 10*j* adjacent end portion 10*f*, yardlines numerically increase from zero to fifty and thereafter decrease to zero until the opposing end zone 10*i* is reached. Thus, it is intended that holes 10*m* number at least one hundred one so as to have an appropriate hole 10*m* adjacent each yardline and both end zones adjacent each end portion 10*e*, 10*f*.

The action sled S is appropriately mounted with the playing field board B of the game G of the present invention. The action sled S includes an upper surface 12*a*, a lower surface 12*b* and longitudinal side portions 12*c*, 12*d* having longitudinally extending projections 12*e*, 12*f* formed therewith. Preferably projections 12*e*, 12*f* of the action sled S are of the same general configuration as channels 10*k*, 10*l* of the side rails 10*g*, 10*h*, respectively, such that the action sled S may be receivably mounted within the channels 10*k*, 10*l* for movably locating the action sled S longitudinally along the playing field board B. Thus, the action sled S is constrained to movement in a longitudinal direction along the length of the playing field board B while further preventing rotation and/or disengagement of the action sled S with the board B. Furthermore, so as to prevent excessive stresses on the projections 12*e*, 12*f*, the side portions 12*c*, 12*d* also ride upon the upper surface 10*a* of the board surface 10 for further supporting the action sled S. The action sled S further has a first player end 12*g* and a second player end 12*h* that will be discussed more fully hereinbelow.

Play selection means P are mounted adjacent first player end 12*g* and second player end 12*h* of the action sled 12 for each opposing player to select their respective offensive and defensive simulated football plays. The play selection means P include play switch means 14, 16 which are mounted adjacent the first and second player ends 12*g*, 12*h*, respectively, for indicating each opposing player's respective offensive and defensive strategy concerning whether the simulated football play is a run, a pass, or a kick. As shown in FIG. 1, play switch means 14, 16 include switches 18, 20. Preferably, switches 18, 20 are of at least a three-position variety so that one of three choices of plays, namely a run, a pass, or a kick, may be appropriately selected by each of the opposing players.

As shown in FIG. 1, a four-position switch is used having a further position designating a "off" mode to be used when the game G of the present invention is not in use. Other additional positions may be added in the event that additional types of football plays are desired to be added, such as a free kick, or in the event that the rules as they exist now are modified to include plays of a different nature and not yet in existence. Each of the switches 18, 20 have run positions 18*a*, 20*a*, pass positions 18*b*, 20*b* and kick positions 18*c*, 20*c*, respectively. As shown in FIG. 3, switches 18, 20 are connected to electrical light bulbs 22, 24 by electrical lines or wires 26, 28, respectively. More specifically, switch positions 18*a*, 18*b*, 18*c* of switch 18 are connected to electric light bulbs 22*a*, 22*b*, 22*c* through electrical lines 26*a*, 26*b*, 26*c*, respectively. In similar fashion, positions 20*a*, 20*b*, 20*c* of switch 20 are connected to electric light bulbs 24*a*, 24*b*, 24*c* by electrical lines or wires 28*a*, 28*b*, 28*c*, respectively. All electric light bulbs 22, 24 are connected to a common electrical line 30 as will be discussed more fully hereinbelow.

Electric light bulbs 22, 24 are preferably mounted in a suitable housing 32 mounted beneath lower surface 12*b* of the action sled 12 (FIG. 2) for example, housing 32*a*, 32*b*, 32*c* house and mount electrical light bulbs 22*a*, 22*b*, 22*c*, respectively. Each of the bulbs 22*a*, 22*b*, 22*c* may be of a different color or in the alternative may be mounted below a piece of colored transparent plastic of any type such that the light from such bulbs 22*a*, 22*b*, 22*c* may appropriately light up in a colorful fashion. As shown in FIGS. 1 and 3, bulbs 22*a*, 24*a* are preferably green (designated "G"), bulbs 22*b*, 24*b* are blue (designated "B"), and bulbs 22*c*, 24*c* are red (designated "R") for indicating the different positions of switches 18, 20, respectively. It will be appreciated that any suitable colors may be used and/or no color may be used if so desired.

Direction selection means D is preferably mounted adjacent first and second player ends 12*g*, 12*h* of the action sled S for each opposing player to select the direction of simulated football play for their respective offensive and defensive maneuverings. The direction selection means D includes direction switch means 34, 36 which include multiposition switches 38, 40, respectively. As is shown in FIGS. 1, 3, switches 38, 40 preferably have seven positions and are so numbered indicating such seven positions. It is not intended that the present invention be limited to switches having only such switch selections but includes those switches having more as well as less selectable positions. The seven positions preferably correspond to potential directions of offensive and defensive strategy relating to the direction with which a simulated football play may be run. Of switches 38, 40, switch positions 38*a*, 40*a* designate a play in the direction of the left end, 38*b*, 40*b* in the direction of the left tackle, 38*c*, 40*c* in the direction of the left guard, 38*d*, 40*d* in the direction of the center, 38*e*, 40*e* in the direction of the right guard, 38*f*, 40*f* in the direction of the right tackle, and 38*g*, 40*g* in the direction of the right end, respectively. Each of the positions 38*a–g*, 40*a–g* of switches 38, 40, respectively, are connected to electrical light bulbs 42, 44 through electrical lines or wires 46, 48, respectively. Thus, multiple positions 38*a–g* are connected to electrical light bulbs 42*a–g* through electrical lines 46*a–g*, respectively. In similar fashion, multiple positions 40*a–g* are connected to electrical light bulbs 44*a*–44*g* through electrical lines 48*a*–48*g*, respectively, as schematically shown in FIG. 3. All electric light bulbs 42*a–g* and 46*a–g* are connected to electrical common 50. Electrical light bulbs 42*a–g*, 44*a–g* are preferably mounted in suitable housings 52 which are appropriately affixed to the lower surface 12*b* of the action sled 12. Suitable openings (not numbered) are formed in the upper surface 12*a* of the action sled 12 to allow the illumination of each of the respective electrical lights 42, 44 to be visible to the opposing players when such lights are illuminated. The lights may be colored, or clear and/or have colored or clear plastic overlays protecting such bulbs. Preferably, bulbs 42, 44 are arranged in two parallel rows such that the midpoint of the distance between such rows falls halfway between first player end 12*g* and second player end 12*h*. This imaginary dividing line marks the line of scrimmage (not numbered) discussed more fully hereinbelow. The line of scrimmage is noted by an appropriate marker 54 (FIG. 1) mounted with the action sled S adjacent the side portion 12*c* of the action sled 12 to be appropriately positioned in directive relation to holes 10*m* formed in the longitudinal side rail 10*g*.

A number of possible switch-electrical light bulb configurations are possible. For example, switch 38 is of a full sweep, 360° variety having preferably seven positions equally disposed about the circumference thereof, with each of the positions marked one thru seven corresponding to similar markings placed over and adjacent to light bulbs 42. On the other hand, switches could be as shown for switch 40 wherein positions one thru seven are equally disposed about 180° rather than 360° as with switch 38. If the switch is as switch 40, numerical designations adjacent the switch need not be incorporated. Appropriate linear markings either etched or printed on the upper surface 12*a* of the action sled 12 may be used to denote the appropriate positioning of the switch 40 as directed to one of the seven potential electrical lights. It should be noted that numbers 1–7corresponding with switch 38 ascend from 1 to 7 from the right to the left as viewed from first player end 12*g* while those numbers associated with switch 40 ascend from 1 to 7 from left to right as viewed from second player end 12*h*. This done purposefully to help facilitate and enhance play of the game G as will be discussed more fully hereinbelow.

Random selection means W is mounted with the action sled S of the game G of the present invention. The random selection means W is a device for selecting random positions necessary in any chance-oriented game and more particularly in the game G of the present invention is for randomly designating a penalty and a non-penalty situation for either of the opposing players during each simulated football play. The random selection means W includes a random selection wheel 58 including a rotatable head 60 and an upstanding base 62. The rotatable head 60 is preferably of a substantially cylindrical disk-like configuration having an upper outer surface 60*a*, and lower outer surface 60*b* joined by annular surface 60*c*. The rotatable head 60 is formed having a cavity 64 therein with the cavity 64 being defined by inner upper surface 60*d*, inner inclined lower surface 60*e* and inner annular surface 60*f* of the rotatable head 60. A plurality of upstanding projections 60*g* are disposed about the inner lower surface 60*e* and extend into the cavity 64. An opening 60*h* is formed in lower surfaces 60*b*, 60*e* having an adjoining collar 60*i* formed therewith.

The upstanding base 62 includes an upper end 61 and a trunk portion 63 separated by outer annular lip 65. Preferably, the trunk portion 63 is appropriately mounted on a platform 66 which in turn is mounted on the upper surface 12*a* of the action sled 12. Preferably, the trunk portion 63 is of a substantially cylindrical configuration, however, any other suitable configuration may be used. The upper end 61 includes an inner portion 61*a* that extends thereinto cavity 64, the inner portion 61*a* connected to center portion 61*b* which is adapted to receive collar 60*i* of the rotatable head 60 such that the collar 60*i* is disposed therebetween the inner portion 61*a* and the outer annular lip 65 of the upstanding base 62. Preferably, the inner portion 61*a* of the upper end 61 is of a substantially disk-like, cylindrical configuration. As shown in FIG. 5, the opening 60*h* of the rotatable head 60 allows the collar 60*i* to be mounted about the center portion 61*b* of the upper end 61. As such, to constrain the head 60 to the upstanding base 62, it is preferred that the radius of the inner portion 61*a* of the upper end 61 be greater than that of the center portion 61*b* of the upper end 61 and the trunk portion 63 so as to constrain the rotatable head 60 therebetween the inner portion 61*a* of the upper end and the annular lip 65 of the upstanding base 62. An appropriate bearing 68 is positioned therebetween the upper inner surface 60*b* of the rotatable head 60 and the upper end 61 of the upstanding base 62 to prevent unwanted vibration and off center rotation of rotatable head 60. The upper end 61 has an upper periphery 61*c* and a lower periphery 61*d* having a plurality of positions 70 disposed thereabout. The positions 70 may include detents, cut-outs, or any other suitable position designating means as well as electrical contacts 72, 74 mounted on the upper periphery 61*c* and lower periphery 61*d* of the upper end 61, respectively. Contacts 72, 74 are adapted to electrically contact movable element 76 which is freely disposed in cavity 64 and adapted to be randomly moved about in the cavity 64 by rotation of the rotatable head 60. Preferably, the movable element 76 is of a spherical configuration and of a metallic, electrically conductive material such that when the movable element 76 engages one of the contacts 72 located on the upper periphery 61*c* of the upper end 61 and a corresponding contact 74 located on the lower periphery 61*d* of the upper end 61, an electrical connection can be made therebetween electrical contacts 72, 74.

Preferably, the height of the disk-like rotatable head 60 therebetween inner upper surface 60*d* and inner lower surface 60*e* should be greater than the sum of the diameter of the movable element 76 and the upstanding projections 60*g* to allow movement of the movable element 76 freely within the confines of the cavity 64.

The rotatable head is adapted to be manually rotated or in the alternative may be powered by a suitable electrical power means such as as electric motor 78. Should the rotatable head 60 be powered by such electric motor 78, preferably a longitudinal bore 62*a* would be formed in the upstanding base 62 and adapted to receive a suitable power shaft 78*a* powered by the electric motor 78 and suitably connected to the rotatable head 60 at connection point 60*j* adjacent end point 78*b* of the power shaft 78*a* for rotatively powering the rotatable head 60. If no electric motor 78 were to be used, the upper end 78*b* could be appropriately used as a knob for spinning the rotatable head 60 as could the annular surface 60*c*.

The upper end 61 of the rotatable head 60 includes a plurality of contacts 72, 74 disposed about the upper periphery 61*c* and lower periphery 61*d* of the upper end 61. FIG. 4 schematically depicts the electrical contacts 72, 74 as disposed about the upper end 61. As noted hereinabove, the random selection means W is for randomly designating a penalty and a non-penalty situation for either of the opposing players during each simulated football play or any desired dual random position. A foul indicator light panel 80 is mounted on the upper surface 12*a* of the action sled 12 and is operatively connected with the contacts 72, 74 mounted with the upper end 61 of the random selection wheel 58. The opposing players and/or teams are designated as team A and team B and such team related electrical contacts 72 are disposed about the periphery 61*c* such that the A and B teams are suitably electrically connected theretogether as with wires 82, 84, as, in part, schematically illustrated in FIG. 4. Of course, such wires would connect all team A contacts together as would wires 84 connect all team B contacts together. Such connected team A wires 82 and team B wires 84 would be connected by wires 86, 88, respectively, to appropriate team A designation electrical light bulb 90 and team B electrical designation light bulb 92, respectively. Assuming that it is desired to have ten random positions to be designated for either team A or team B, the appropriate pairing of contacts 74 with team contacts 72 may be as shown in FIG. 4 with each of the contacts 74 having appropriate wiring such as wire 94 from the contact to an appropriate electrical light bulb 96. The operation of the movable element 76 in connection with the electrical contacts 72, 74 and the operative features thereof will be discussed more fully hereinbelow.

A divider gate 98 is mounted with the action sled 12 for separating the first player end 12*g* from the second player end 12*h* for providing a shield to prevent each of the opposing players from discovering the other's strategy prior to commencement of the simulated football play. Preferably, the divider gate is placed along the imaginery line of scrimmage as noted by marker 54 and is hingeably mounted by hinge 100 to the action sled 12. The divider gate 98 is mounted in an upstanding fashion having a base portion 98*a* in abutting relation to the upper surface 12*a* of the action sled S with the divider gate 98 being movable from a position wherein the base portion 98*a* is in engagement with the upper surface 12*a* of the action sled 12 and is movable to a non-engaged position such that the base portion 98*a* no longer resides in the abutting relation with the upper surface 12*a* of the action sled S which is schematically shown as non-engaged position 102 in FIG. 2. Switch 104 preferably of a make-break, push button variety and switch 106 of a push button variety are mounted directly beneath the divider gate 98 such that when the divider gate is in an engaged position, the push button portions 104*a*, 106*a* of switches 104, 106 are depressed due to the weight of the divider gate 98 thereon and are in non-contacting positions (see FIGS. 2, 3, 4). Movement of the divider gate 98 from the engaged position to the non-engaged position 102 results in springs 104*b*, 106*b*, respectively, urging switches 104, 106 into a closed, switched position as depicted in FIGS. 3 and 4.

Figure 6A:
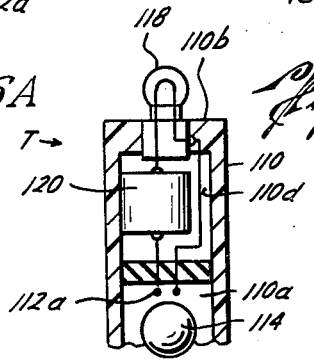
FIG. 6A is an elevational, sectional view of one form of the contact-electrical light assembly of the game timer of the present invention.
Figure 6B:
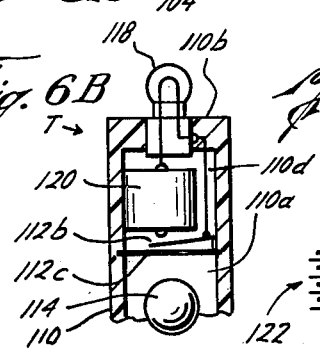
FIG. 6B is an elevational, sectional view showing a second embodiment of the contact-electrical light assembly of the game timer of the present invention; and, FIG. 6C is an elevational, sectional view of a third embodiment of the contact-electrical light assembly of the game timer of the present invention.
Figure 6C:
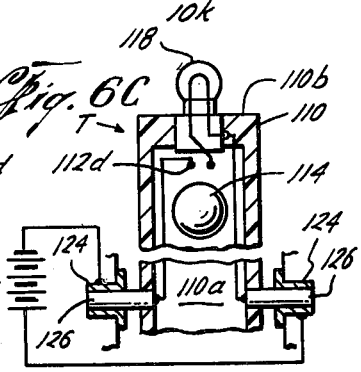

Timing means T for interval timing during a game such as the game G of the present invention is useful for determining the interval of time therebetween successive simulated football plays and indicating an expiration of time resulting in a penalty for an offensive player for excessive use of time therebetween successive plays. The timing means T includes game timer 108 as shown in FIGS. 2, 6A, 6B and 6C. The game timer 108 includes an elongate housing 110 having a chamber 110*a* formed therein. The housing 110 further includes a first end 110*b* and a second end 110*c*. The chamber 110*a* is preferably capable of sealably containing a liquid therein and further has fixed electrical contacts 112 mounted adjacent each end 110*b*, 110*c* of the chamber 110*a*. The contacts 112 include a pair of exposed contacts 112*a* that extend thereinto chamber 110*a* as shown in FIG. 6A or alternatively include a diaphragm 112*c* and wiper 112*b* arrangement as shown in FIG. 6B. A further alternative includes the exposed contact arrangement 112*d* as shown in FIG. 6C. A movable electrical contact 114 of an electrically conductive material is preferably of a hollow, spherical configuration and adapted to be disposed within the liquid in chamber 110*a* of the elongate housing 110. The movable electrical contact 114 is capable of descending through the liquid in the chamber 110*a* upon pivoting of the elongate housing 110 about pivots 116 which pivotally mount the elongate housing 110 with the divider gate 98. Pivoting of the housing 110 results in the movable electrical contact 114 descending through the liquid, which may be of any viscosity, until such movable electrical contact 114 engages fixed contacts 112 at either end 110*b*, 110*c* of the housing 110 to activate one of two electrical lights 118 mounted at each end 110*b*, 110*c* of the elongate housing 110. As shown in FIGS. 6A and 6B, an electrical power source such as miniature batteries 120 may be disposed at each end of the elongate housing 110 to provide electrical power for activating the circuitry and for weighting each end of the housing so as to provide substantially vertical disposition of the housing 110 to enhance the gravitational effects on the movable contact 114 within the chamber 110*a*. In FIG. 6A, the battery 120 is sealed within chamber 110*d* adjacent the end 110*b* of the game timer 108 and is in suitable electrical connection with the electrical light 118 and contacts 112*a*. In FIG. 6B, the battery 120 is similarly disposed in a chamber 110*e* therebetween the diaphragm 112*c* and the end most extremity 110*b* of the game timer 108 and is in proper electrical communication therewith light bulb 118 and contact wiper 112*b*. Still further, as shown in FIG. 6C, the game timer 108 may have an exterior electrical power source such as batteries 122 which may electrically activate bulb 118 upon closure of contacts 112*d* by movable electric contact 114. By having an electrical bushing 124 and support 126 appropriately connected to battery 122 allowing rotation of the game timer 108 about support 126 in a 360°, fully pivoting relationship, proper electrical connection may be made. Thus support 126 electrically communicates with bushing 124 as the support 126 rotates in respect thereto. Thus, rotation of the timer results in the movable electrical contact 114 drifting and/or descending through the liquid within sealed chamber 110*a* of the elongate housing until the movable electrical contact 114 engages fixed electrical contact 112 which in turn activates electrical light 118 thus signalling expiration of time.

The divider gate 98 further has suitable openings 98*c* formed therein to permit disposition of statistical information recorders 128. Preferably, the statistical information recorders 128 are constructed in such a fashion that the information conveyed is visible by each player viewing from each respective end 12*g*, 12*h* of the action sled S. All of the recorders 128 preferably have a knurled ring 128*a* to enhance ease of adjusting thereof. The statistical information recorders 128 include a down recorder 128*b*, a yard to gain recorder 128*c*, a yards to first recorder 128*d*, a team A score recorder 128*e*, and a team B score recorder 128*f*. The dual feature visibility of information on such recorders 128 may be accomplished by appropriately forming the openings 98*c* on each side of the divider gate such that each reveals one of two 180° out of phase numerical designations such that the same information is conveyed on both sides of the divider gate 98 to each of the opposing players.

Furthermore, it is desired that rules information sheet 130 concerning the rules for directing the actual simulated football play be appropriately affixed to the divider gate 98 to be readily accessible to both of the opposing players during simulated football play. Preferably, the rules information sheet 130 is mounted on the divider gate such that when the divider gate is in a non-engaged position 102 that is substantially perpendicular to the action sled S, the rules information sheet 130 is in a proper horizontal disposition for ease of reading by each of the opposing players inasmuch as such rules information sheets 130 are mounted on both sides of the divider gate 98. Thus, when the divider gate 98 is in an engaged position, the rules information sheets 130 are difficult to read inasmuch as they are vertically disposed rather than horizontally disposed increasing the difficulty of reading thereof.

An electrical power source 132 is used to activate and power the various electrical components of the game G of the present invention. The electrical power source preferably includes a plurality of batteries 132*a* appropriately mounted in battery housing 132*b*. Alternatively, standard household electrical alternating current could be used either in a transformed or an untransformed capacity for powering the game G. Also, batteries 132*a* may serve as the power source for game timer 108 depicted in FIG. 6C, with batteries 132*a* being identical with those designated as batteries 122.

In the use or operation of the game G of the present invention, the object of which is for each of the opposing players to score the most points by effective offensive strategy to out maneuver his opponent's defensive positonings. As shown in FIG. 1, it is assumed that play of the game G of the present invention has been commenced and that team A is positioned behind first player end 12*g* and team B is positioned behind second player end 12*h*. As shown, team A has opted to "throw a pass" by appropriately positioning the switch 18 to pass position 18*b*. Team A has also decided that the pass will be directed in the direction of the right guard and thus multi-position switch 38 is turned to position 38*e* which designates such a right guard direction. Team B, not knowing these positions of switches 14, 34 inasmuch as they are not visible because of the divider gate 98 being in the engaged position, attempts to determine the strategy of team A due to the circumstances of play. As shown in FIG. 2, team A is faced with a third down with ten yards to go to make a first down, thus team B has guessed that team A will throw a pass and appropriately positions switch 20 to the pass position 20*b*. However, team B suspects that the play will be directed over team A's left guard (or team B's right guard) and appropriately positions multi-position switch 36 at right guard position 40*e*. When both teams agree that their strategy has been appropriately mapped out by the appropriate positioning of switches 14, 16, 34, 40, the divider gate 98 is moved from the engaged position to a non-engaged position 102 such that the divider gate 98 is substantially perpendicular to the action sled S.

Pivotal movement of the divider gate 98 to such non-engaged position 102 results in the formerly depressed switches 104, 106 being urged upwardly in response to springs 104*b*, 106*b* resulting in closing of switches 104, 106. The closing of switch 104 which is of a make-break variety, results in intermittent powered rotation of the rotatable head 60. The intermittent rotation of the rotatable head 60 results in the random movement of the movable element 76 within the cavity 64 of the rotatable head 60. The upstanding projections 60*g* within the cavity 64 further engage and distribute the movable element 76 in such a fashion that the element 76 is throughly and randomly moved about within the cavity 64. The movable element 76 may come to rest in one of twenty potential penalty positions wherein the movable element 76 engages a pair of contacts 72, 74 or in the alternative may come to rest in some location there-between such contacts 72, 74 resulting in a non-penalty play.

As shown in FIG. 4, the movable element 76 has come to rest indicating two randomly selected positions. First, team A is to be penalized in accordance with the penalty designated as "penalty 8" resulting in the activation of electric light bulb 90 designating team "A". Secondly, the bulb 96 designating "8" of the foul indicator light panel 80 is illuminated inasmuch as switch 106 has been appropriately closed in response to spring 106*b*. Thus, two random positons are generated by the random selection means W. The random selection means W is not limited to merely dual random positions but may designate as many different random possibilites as desired, limited by the physical size of such a device.

This closing of switch 106 further results in activating electrical lights 22*b*, 24*b* indicating each player's selection of type of offensive and defensive plays as well as the direction of such plays which results in lights 42*e* and 44*e* appropriately being activated due to the proper electrical communication thereof as shown schematically in FIG. 3. Thus, by merely moving the divider gate 98 from the engaged to non-engaged position 102, the strategy of both offensive and defensive teams is revealed as well as whether or not the simulated football play results in a penalty or non-penalty situation. In this particular example, it is evident that the defensive team B has properly defensed the type of play, however, incorrectly chose the direction of the play while during the course of the play, and in accordance with the random selection wheel 58, has resulted in team A being penalized. When yards are gained and/or lost by an offensive team, the action sled S is appropriately moved along the board B such that the marker 54 points adjacent to the specific yardline achieved. An appropriate peg 134 (FIG. 2) may be placed in the appropriate hole 10*m* to designate the line of scrimmage of each simulated football play. Thus, the action sled S is moved along the board B in response to offensive plays by each team until either team scores whereinafter the process is repeated.

It is intended that the game G of the present invention be relatively simple to play and based upon color coding, in part, to simplify the game in conjunction with a chart as shown hereinbelow:

| PLAY: Indicator Color of Offensive Team "A" and Defensive Team "B" | | | Difference (0 to 6) between attack areas selected gives yardage gained or lost. | | | | | | |
|---|---|---|---|---|---|---|---|---|---|
| Team A | Team B | Play is a | 0 | 1 | 2 | 3 | 4 | 5 | 6 |
| G | G | RUN | −10 yd. | −5 | n/g | +5 | +3 | +10 | +15 |
| B | B | PASS | (2*)"B"−10 | "B"−20(*3) | n/g | +5 | +3 | +10 | +15 |
| G | B | | −5 | n/g | +3 | +7 | +5 | +15 | +20 |
| B | G | | −5 | n/g | +3 | +7 | +5 | +15 | +20 |
| R | R | S/K | "B"+15(*4) | 1/s | +20 | +25 | +30 | +35 | +40 |
| R | R | F/G | "B"+15(*5) | "B"+15(*6) | +30 | +35 | +40 | +45 | +50 |

-continued

| PLAY: Indicator Color of Offensive Team "A" and Defensive Team "B" | | | Difference (0 to 6) between attack areas selected gives yardage gained or lost. | | | | | | |
|---|---|---|---|---|---|---|---|---|---|
| Team A | Team B | Play is a | 0 | 1 | 2 | 3 | 4 | 5 | 6 |
| R | R | FREE | +20 | +25 | +30 | +35 | +60 | +45 | +55 |

(2*) & (*3) = "B" intercepts 10&20 yds., respectively, beyond line of scrimmage and downed.
(*4, *5, *6) = Kick Blocked & "B" recovers 15 yds. behind line of scrimmage.
n/g = no gain on run, and forward pass incomplete on a pass play.
If a Kick is not blocked then it belongs to "B" at the distances shown, except if distance sufficient to reach the end zone resulting in 3 points scored if a declared F/G attempt.
Team must declare a kick and type of kick - thus on a kick both indicators are RED (R).
Color Code:
G = Green
B = Blue
R = Red A chart such as this is used as the rules information sheet 130 and is mounted on the divider gate 98. According to the color indicated by bulbs **22*b*, 24*b*, the appropriate line is identified with the column labeled "Play". For the particular example shown in the drawings, that labeled "B B" indicating that lights 22*b*, 24*b* are blue in color is checked inasmuch as both of such lights are activated. Differences in direction of attack determine the appropriate yardage gained based upon the particular plays offensively and defensely selected. As noted in the present example, team A chose position 38*e* and team B chose position 40*e* which resulted in activation of the "No. 3" light 42*e* of team A and the "No. 5" light 44*e* of team B resulting in a difference of 2, that is 5—3=2. Due to the fact that the numbering of the lights for both teams are directly opposed, either player need only look at the two burning lights and subtract the two numbers adjacent thereto to determine the directional differences. Thus, if both selected positions resulting in the illumination of lights 42*b*, 42*f*** resulting in illumination of both "No. 6" lights, the resulting difference would be zero. However, as in the present example, the difference in the attack direction is two and therefore looking down column labeled "2" adjacent to the line designated "B B", the resulting direction is "n/g" which designates no gain, or an incomplete pass, as is the case here. Thus, team A makes no gain on the play according to the offensive and defensive strategies of each team. Thus, the offensive team A can call for a run (green), pass (blue) or kick (red) into one of the seven areas or directions which include the left end, left tackle, left guard, center, right guard, right tackle, right end. The defensive team B's ability to anticipate the area of attack determines the yards gained or lost by the offensive team A in accordance with the color-coded chart and the line of scrimmage is moved accordingly. Thus, if offensive team B correctly surmised team A's offense to be a run (both indicators green), and in the exact direction, the chart shows that team A was thrown for a 10 yard loss. However, if a four-lane directional difference existed, then team A would result in a five-yard gain and the action sled S would be appropriately advanced five yards.

If offensive team A chose to simulate a scrimmage kick and both teams A and B resulted in a choice of identical directions, then the color-coded chart notes that the scrimmage kick was blocked and that defensive team B recovered and was tackled 15 yards behind offensive team A's line of scrimmage. Thus, if the ball was snapped for the kick from team B's 40 yardline, then the ball would belong to team B on team A's 45 yardline. Alternatively, if the line of scrimmage was on team A's 10 yardline, then team B's recovery was 15 yards behind and therefore in teams A's end zone and results in a touchdown for team B.

If both indicators are red and a choice of the kick resulted in it being blocked and recovered by the kicking team on their own line of scrimmage on a fourth down situation, it results in the ball being turned over the defensive team B. Should the distance from the line of scrimmage put the ball in the defensive team B's end zone, it results in a touch back wherein the "ball" (action sled S) is brought out to team B's 20 yardline wherein play resumes with team B being the offensive team A and team A becoming the defensive team B.

As is apparent from the above discussion, the entire flavor of the game G can be easily altered merely by changing the appropriate values of the respective particular play-direction combinations. Thus the game G can be made a "hot" game by increasing the value for each particular combination or, in the alternative, it can be made a "cooler", slower game as so desired.

The penalty situation as indicated on the foul indicator light panel 80 is to be appropriately designated and described as part of the rules information sheet 130. Penalty sheets should include one sheet designating offensive and defensive fouls should the play type be of a "run"; one sheet should be of offensive and defensive fouls should the play be of a "pass" type; and, one sheet should be that designating offensive and defensive fouls should the play be of a "kick" type. The rules and their respective violations thereof may change from year to year according to the rules that are actually in existence during that particular season's play, be they for professional football or for collegiate football. Thus, by merely changing the sheets designating such offensive and defensive errors on the three respective types of plays, the game G will reflect current standing rules as used in actual football play.

The following tables are for illustrative purposes and may be used to determine the effect of fouls committed by the offensive team (Team A) during each of the three types of play modes:

TEAM A (OFFENSIVE) FOULS DURING A KICK PLAY

| FOUL | OCCURS | THE FOUL IS | Penalty & Enforcement Spots "A"s Foul is "A"s End Zone | "A"s Foul is in Field of Play | "B"s End Zone |
|---|---|---|---|---|---|
| 1 | At L/S or R/L | Offsides | — | P/S-5 | — |
| 2 | L/S-5 Yards | P or H | Safety | Spot-15 | — |
| 3 | L/S + 10 Yards | P or H | Safety | P/S-15 | P/S-15 |
| 4 | L/S + 20 Yards | P or H | Safety | P/S-15 | P/S-15 |
| 5 | At L/S | P or H | Safety | P/S-15 | P/S-15 |
| 6 | L/S + 15 | Illegally Kicking/Batting except Batting in "B"s End Zone of a S/K untouched by "B" | Safety | P/S-15 | P/S-15 T/B |
| 7 | L/S + 10 | Opportunity to Catch Interference | — | Spot-15(B's) | T/B |
| 8 | L/S + 25 | Opportunity to Catch Interference | — | Spot-15(B's) | T/B |
| 9 | Spot of Catch | F/C Interference (Dead Ball Foul) | — | Spot-15(B's) | 1st&10 on 35 |
| 10 | Spot of Catch | F/C Interference (Dead Ball Foul) | — | Spot-15(B's) | 1st&10 on 35 |

Code:
G/L = goal line
L/S = line of scrimmage
P/S = previous spot
F/C = fair catch
P = personal foul
H = illegal use of hands
T/B = touchback
S/K = scrimmage kick
R/L = restraining line

TEAM A (OFFENSIVE) FOULS DURING A FORWARD PASS

| FOUL | OCCURS | THE FOUL IS | Penalty & Enforcement Spots "A"s Foul is "A"s End Zone | "A"s Foul is in Field of Play | "B"s End Zone |
|---|---|---|---|---|---|
| 1 | At L/S | Offisdes | — | P/S-5 | — |
| 2 | L/S+10 | F/P Interference | — | P/S-15-L/D | P/S-15-L/D, (or T/B) |
| 3 | L/S+15 | F/P Interference | — | P/S-15-L/D | P/S-15-L/D, (or T/B) |
| 4 | L/S+5 | Blocks beyond N/Z | — | P/S-15-L/D | P/S-15-L/D, (or T/B) |
| 5 | L/S+20 | Ineligible touches beyond N/Z | — | P/S-15-L/D | P/S-15-L/D, (or T/B) |
| 6 | L/S−10 | Ineligible touches behind N/Z | P/S-5 | P/S-5 | — |
| 7 | L/S+25 | Lost Eligibility touches | L/D at P/S | L/D at P/S | L/D at P/S |
| 8 | L/S+5 | Ineligible illegally beyond N/Z | — | P/S-15 | P/S-15 |
| 9 | L/S+10 | "P"/"H" beyond after Touched | — | P/S-15 | P/S-15 |
| 10 | L/S−10 | "P"/"H" behind after Touched | Safety | Spot-15 | — |

Code:
L/S = line of scrimmage
F/P = forward pass
P = personal foul
H = illegal use of hands
N/Z = neutral zone
L/D = loss of down
P/S = previous spot
T/B = touchback

TEAM A (OFFENSIVE) FOULS DURING A RUN

FOUL 1 or 2 is Offsides by "A" and occurs at L/S(P/S). Penalty is P/S-5 yards.
FOUL 3, 4, 5 or 6 occurs AHEAD of the R/E. (5, 10, 15 & 20 yards respectively)
FOUL 7, 8, 9 or 10 occurs BEHIND the R/E. (5, 10, 15 & 20 yards respectively)
EXECUTE play as if no Foul occurred - this is R/E. Now locate the R/E on the Board, then locate spot of Foul, this gives the correct Penalty.

OFFENSIVE TEAM "A" fouls at spot (x"A") and R/E is Spot Run Ends
P/S = a yard line from which ball was snapped.

| BEHIND "A"G/L | Field of Play P/S | | BEHIND "B"G/L | "A"s Penalty is from |
|---|---|---|---|---|
| | | | R/E x"A" | a. G/L of "A" |
| x"A"(Safety) | x"A" | x"A" R/E x"A" | R/E | b. Spot of Foul - 15 Yards |
| | | | | c. R/E - 15 |
| x"A"(Safety) | x"A" R/E | x"A" R/E x"A" | | d. Spot of Foul - 15 |
| | | | | e. P/S - 15 |
| x"A"(Safety) | R/E x"A" | | | f. Spot of Foul - 15 |
| x"A" R/E | | | | g. Safety |
| "A"s | "A"s Foul is | | "B"s | |

-continued

| End Zone | Between G/L's | End Zone |
|---|---|---|

Code:
G/L = goal line

The following tables are for illustrative purposes and may be used to determine the effect of fouls committed by the defensive team (Team B) during each of the three types of play modes:

TEAM B (DEFENSIVE) FOULS DURING A KICK PLAY

| FOUL | OCCURS | THE FOUL IS | Penalty & Enforcement Spots "B"s Foul is "A"s End Zone | "B"s Foul is in Field of Play | "B"s End Zone |
|---|---|---|---|---|---|
| 1 | At L/S or R/L | Offsides | — | P/S-5 | — |
| 2 | L/S−5 | "P" or "H" Foul | P/S-15 | P/S-15 | P/S-15 |
| 3 | L/S+10 | | P/S-15 | P/S-15 | P/S-15 |
| 4 | L/S+20 | | P/S-15 | P/S-15 | P/S-15 |
| 5 | At L/S | | P/S-15 | P/S-15 | P/S-15 |
| 6 | L/S+15 | Illegally Kicking/Batting | P/S-15 | P/S-15 | P/S-15 |
| 7 | L/S−10 | Roughing Kicker or Holder | P/S-15 | P/S-15 | — |
| 8 | At Spot of Catch | Illegal F/C Signal | — | Spot-15(B's) | Safety |
| 9 | L/S+20 | Signals F/C, no touch, Blocks* | — | Spot-15 | Safety |
| 10 | L/S+20 | *if below waist enforce at P/S | P/S-15 | P/S-15 | P/S-15 |

Code:
F/C = fair catch
P = personal foul
H = illegal use of hands

TEAM B (DEFENSIVE) FOULS DURING A FORWARD PASS

| FOUL | OCCURS | THE FOUL IS | Penalty & Enforcement Spots "B"s Foul is "A"s End Zone | "B"s Foul is in Field of Play | "B"s End Zone |
|---|---|---|---|---|---|
| 1 | At L/S | Offsides | — | P/S-5 | — |
| 2 | L/S+10 | F/P Interference | — | A's at Spot | 1st&10 at P/S |
| 3 | L/S+15 | F/P Interference | — | A's at Spot | 1st&10 at P/S |
| 4 | L/S+20 | F/P Interference | — | A's at Spot | 1st&10 at P/S |
| 5 | L/S+25 | F/P Interference | — | A's at Spot | 1st&10 at P/S |
| 6 | L/S+30 | F/P Interference | — | A's at Spot | 1st&10 at P/S |
| 7 | L/S−5 | A "P" or "H" behind N/Z | P/S-15 | P/S-15 | P/S-15 |
| 8 | L/S−10 | Ineligible legally beyond N/Z, OR | P/S-15 | P/S-15 | P/S-15 |
| 9 | L/S+5 | occurs after F/P touched, OR it is | P/S-15 | P/S-15 | P/S-15 |
| 10 | L/S+20 | illegally kicking a F/P | P/S-15 | P/S-15 | P/S-15 |

TEAM B (DEFENSIVE) FOULS DURING A RUN

FOUL 1 or 2 is Offsides by "A" and occurs at L/S(P/S). Penalty is P/S-5 yards.
FOUL 3, 4, 5 or 6 occurs AHEAD of the R/E (5, 10, 15 & 20 yards respectively).
FOUL 7, 8, 9 or 10 occurs BEHIND the R/E (5, 10, 15 & 20 yards respectively).
EXECUTE Play as if no Foul occured - this is the R/E. Now locate the R/E on the Board, then locate Spot of Foul - this gives the correct Penalty.

DEFENSIVE team "B" fouls at spot (x"B") and R/E is Spot Run Ends
P/S = a yard line from which ball was snapped

| BEHIND "A"G/L | | Field of Play P/S | BEHIND "B"G/L | "B"s Penalty is from |
|---|---|---|---|---|
| x"B" | x"B" | x"B" | R/E 3"B" | a. S/S (at K/O)-15 yards |
| x"B" | x"B" | x"B" R/E x"B" | x"B" | b. R/E -15 |
| x"B" | R/E x"B" | x"B" | x"B" | c. P/S -15 |
| x"B" R/E | x"B" | x"B" | x"B" | d.P/S -15 |
| "A"s End Zone | | "B"s Foul is Between G/L's | "B"s End Zone | |

Code:
S/S = succeeding spot

The above-identified offensive and defensive team foul charts are to be used in a similar manner as discussed hereinabove regarding the play chart.

After each simulated football play is completed, the divider gate 98 is returned to its engaged position which deactivates all of such activated light bulbs whereupon each player redirects his attentions towards the next successive simulated football play. When the divider gate 98 is replaced, the game timer 108 should be pivoted such that the movable electrical contact 114 begins to descend along the elongate housing 110 within chamber **110*a*** thereby limiting the amount of time each player takes in selecting his offensive and/or defensive play. Should the movable electrical contact 114 engage contacts 112 resulting in activation of electrical light 118, an appropriate penalty should be called for delay of game.

It is not intended that the game timer 108 of the present invention be limited to the game G of the present invention for the timing means T could be incorporated for use in a wide variety of games or in any other type of situation where a signal light means of indicating expiration of time would be of value. Furthermore, the random selection wheel 58 is not intended to be limited to the game G of the present invention and may be used in any situation where a randomly generated sequence is desired.

Furthermore, it is intended that the game G of the present invention be used as an educational aid in teaching and learning the strategy of football, as it is actually played.

The foregoing disclosure and description of the invention are illustrative and explanatory thereof, and various changes in the size, shape and materials as well as in the details of the illustrated construction may be made without departing from the spirit of the invention.

I claim:

1. A game simulating the play of football to be played by at least two opposing players, comprising:

a playing field board simulating a football field having two opposing end zones;

an action sled mounted adjacent said playing field board and movable along the length of said board, said action sled having a first player end and a second player end, each of said first and second player ends respectively opposing one of said end zones;

play selection means mounted adjacent said first and second player ends of said action sled for each opposing player to select their respective types of offensive and defensive simulated football plays;

direction selection means mounted adjacent said first and second player ends of said action sled for each opposing player to select the direction of the simulated football play for the respective offensive and defensive maneuverings of each player; and, random selection means mounted with said action sled for randomly designating a penalty and a non-penalty situation for either of the opposing players during each simulated football play.

2. The game of claim 1, wherein each of said play selection means includes:

play switch means mounted with said first and second player ends of said action sled for indicating each opposing player's respective offensive and defensive strategy concerning whether the simulated football play is a run, a pass, or a kick.

3. The game of claim 2 further including an electrical power source, wherein each of said play switch means includes:

at least two multi-position switches, each of said switches having a run position, a pass position, and a kick position, and each of said switches being electrically connected to play electrical lights for indicating each opposing player's choice of one of said positions, said play electrical lights being operatively connected to the electrical power source such that after each opposing player's simulated football play has been decided and appropriately designated by movement of said switch to one of said positions, one of said play electrical lights is activated.

4. The game of claim 1, wherein each of said direction selection means includes:

direction switch means mounted with said first and second player ends of said action sled for indicating each opposing player's respective offensive and defensive strategy concerning the direction of the simulated football play.

5. The game of claim 4 further including an electrical power source, wherein each of said direction switch means includes:

at least two multi-position switches, each of said switches having switch positions indicating center, left guard, right guard, left tackle, right tackle, left end and right end, each of said multi-position switches being electrically connected to direction electrical lights for indicating each opposing player's choice of one of said positions, said direction electrical lights being operatively connected to the electrical power source such that after each opposing player's simulated football play has been decided and appropriately designated by movement of said multi-position switch to one of said positions, one of said direction electrical lights is activated.

6. A game simulating the play of football to be played by at least two opposing players, comprising:

a playing field board simulating a football field having two opposing end zones;

an action sled mounted adjacent said playing field board and movable along the length of said board, said action sled having a first player end and a second player end, each of said first and second player ends respectively opposing one of said end zones;

play selection means mounted adjacent said first and second player ends of said action sled for each opposing player to select their respective types of offensive and defensive simulated football plays;

direction selection means mounted adjacent said first and second player ends of said action sled for each opposing player to select the direction of the simulated football play for the respective offensive and defensive maneuverings of each player; and, random selection means mounted with said action sled for randomly designating a penalty and a non-penalty situation for either of the opposing players during each simulated football play, wherein said random selection means includes:

a random selection wheel including a rotatable head and an upstanding base having an upper end and a trunk portion;

said rotatable head formed having a cavity therein and adapted to be rotatively mounted with said upper end of said upstanding base such that said head rotates with respect to said base and said upper end of said base extends into said cavity;

a movable element freely disposed in said cavity and adapted to be randomly moved about in said cavity by rotation of said head; and, a plurality of positions disposed about said upper end of said base and adapted to receive said movable element for indicating both the type of penalizing foul committed and which of the opposing players committed such foul.

7. The game of claim 6, wherein:

said head of said random selection wheel has a base portion having a plurality of upstanding projections which extend into said cavity for enhancing random movement of said movable element within said cavity when said head is rotated.

8. The game of claim 7, wherein:

said movable element is of a spherical configuration;

said trunk portion is of a substantially cylindrical configuration;

said upper end is of a substantially cylindrical disk-like configuration, said upper end having a diameter greater than the diameter of said trunk portion; and, said head is of a substantially cylindrical disk-like configuration having a radius of greater magnitude than the sum of the diameter of said movable element and the radius of said upper end and a height of greater magnitude than the sum of the height of said projections and the diameter of said spherical movable element.

9. The game of claim 7 further including an electrical power source, wherein:

said upper end has a plurality of electrical contacts disposed about the upper and lower periphery of said upper end, said electrical contacts being electrically connected to a plurality of penalty electrical lights mounted with said action sled; and, said movable element is of an electrically conductive material such that when said element engages one of said contacts located on said upper periphery of said upper end and one of said contacts located on the lower periphery of said upper end, a pair of said penalty electrical lights are activated for designating both the player to be penalized as well as the nature of the penalty being charged.

10. The game of claim 9, wherein:

said head is intermittently rotated by a power means operatively connected to the electrical power source to randomly move said movable element within said cavity.

11. The game of claim 9, further including:

a foul indicator light panel mounted with said action sled and having a plurality of said penalty electrical lights for indicating both the various types of penalties committed during simulated football play and which of the opposing players committed the penalty, said penalty electrical lights being electrically connected with said contacts located on the upper and lower periphery of said upper end to operatively activate selected penalty electrical lights when said movable element contacts a pair of corresponding selected electrical contacts.

12. A game simulating the play of football to be played by at least two opposing players, comprising:

a playing field board simulating a football field having two opposing end zones;

an action sled mounted adjacent said playing field board and movable along the length of said board, said action sled having a first player end and a second player end, each of said first and second player ends respectively opposing one of said end zones;

play selection means mounted adjacent said first and second player ends of said action sled for each opposing player to select their respective types of offensive and defensive simulated football plays;

direction selection means mounted adjacent said first and second player ends of said action sled for each opposing player to select the direction of the simulated football play for the respective offensive and defensive maneuverings of each player;

random selection means mounted with said action sled for randomly designating a penalty and a non-penalty situation for either of the opposing players during each simulated football play; and, an upstanding divider gate hingeably mounted with said action sled separating said first player end from said second player end for providing a shield to prevent each of the opposing players from discovering the other's strategy prior to commencement of the simulated football play, said divider gate having a base portion, said divider gate being movable from a position wherein said base portion is in engagement with said action sled prior to commencement of each of the simulated football plays to a non-engaged position when commencing the simulated football play.

13. The game of claim 12, wherein:

said play selection means, said direction selection means, and said random selection means are electrically activated by an electrical power source mounted with said action sled; and, movement of said divider gate from said engaged position to said non-engaged position electrically activates all said means and movement from said non-engaged position to said engaged position deactivates all of said means.

14. The game of claim 12, further including:

statistical information recorders for recording down number, yards to gain, yards to first, and scoring for each of the opposing players, said statistical information recorders mounted on said divider gate.

15. The game of claim 12, further including:

plural rules information sheets concerning the rules directing actual simulated football play, said rules information sheets mounted with said divider gate such that said sheets are easily readable by the opposing players when said divider gate is in said non-engaged position.

16. A game simulating the play of football to be played by at least two opposing players, comprising:

a playing field board simulating a football field having two opposing end zones;

an action sled mounted adjacent said playing field board and movable along the length of said board, said action sled having a first player end and a second player end, each of said first and second player ends respectively opposing one of said end zones;

play selection means mounted adjacent said first and second player ends of said action sled for each opposing player of select their respective types of offensive and defensive simulated football plays;

direction selection means mounted adjacent said first and second player ends of said action sled for each opposing player to select the direction of the simulated football play for the respective offensive and defensive maneuverings of each player;

random selection means mounted with said action sled for randomly designating a penalty and a non-penalty situation for either of the opposing players during each simulated football play; and, timing means mounted with said action sled for noting the interval of time therebetween successive simulated football plays and indicating an expiration of time resulting in a penalty for an offensive player for excessive use of time therebetween successive plays.

17. The game of claim 16, wherein said timing means includes:

an elongate housing pivotally mounted with said action sled and formed with a sealed chamber therein, said chamber adapted to receive liquid therein, said chamber having an electrical contact at each end thereof and said housing having an electrical light at each end thereof, each of said contacts and said lights at each respective end of said chamber and said housing being operatively connected theretogether;

an electrical power source with said housing, operatively connected with said electrical lights and said contacts; and, a movable electrical contact capable of descending through said liquid in said chamber and engaging said contacts at one end of said chamber for completing the circuitry to activate one of said electrical lights for indicating expiration of time.

18. The game of claim 1, wherein:

said playing field board is of a substantially rectangular configuration, and includes a pair of longitudinally extending side rails each having a longitudinally extending channel formed therein, said side rails being mounted along the length of said board; and, said action sled is movably mounted therebetween said channels and has a pair of longitudinally extending projections adapted to be received by said channels in said side rails to constrain said action sled to longitudinal movement along the length of said board.

* * * * *